United States Patent [19]

Usui et al.

[11] Patent Number: 4,969,799

[45] Date of Patent: Nov. 13, 1990

[54] BLOWER FAN BLADE

[75] Inventors: Masayoshi Usui; Takeshi Matsumoto, both of Numazu, Japan

[73] Assignee: Usui Kokusai Sangyo Kaisha Ltd., Japan

[21] Appl. No.: 431,481

[22] Filed: Nov. 3, 1989

[30] Foreign Application Priority Data

Nov. 21, 1988 [JP] Japan ..... 63-294430

[51] Int. Cl.[5] ..... B63H 3/00; F01D 5/12

[52] U.S. Cl. ..... 416/39; 415/12

[58] Field of Search ..... 416/39, 223 R, 229 R; 415/12

[56] References Cited

U.S. PATENT DOCUMENTS 3,373,930 3/1968 Rom ..... 415/12 X
4,778,339 10/1988 Usui et al. ..... 416/39
4,846,629 7/1989 Takigawa ..... 416/223
4,859,150 8/1989 Takigawa ..... 416/223 R

FOREIGN PATENT DOCUMENTS 1334259 6/1963 France ..... 415/12

*Primary Examiner*—William E. Wayner
*Attorney, Agent, or Firm*—Anthony J. Casella; Gerald E. Hespos

[57] ABSTRACT

Each blade of a blower fan has a parallel wire group for each side whose thermal expansion coefficient is smaller than that of the blade. The two parallel wire groups are provided substantially over the whole area of a suction-side surface and of a discharge-side surface of the blade such that they extend from the front edge of the suction-side surface and from the rear edge of the discharge-side surface outward obliquely to the radial direction of the blade to cross each other on the face and back sides so as to result in the shape of an "X". Due to a difference of thermal expansion coefficient, in a high-temperature state, camber appears on the blade in oblique directions, and the front edge and the rear edge camber in opposite directions; thus, the blade undergoes torsional deformation to largely vary the angle of incidence.

11 Claims, 3 Drawing Sheets

BLOWER FAN BLADE

BACKGROUND OF THE INVENTION

1. Field of the Invention

This invention relates to a blade of a blower fan used in cooling car engines and the like.

2. Description of the Prior Art

A conventional blade 12 of a blower fan as shown in FIGS. 5 and 6 projects from the outer periphery of a boss body 11, which has a bimetal 15 secured to a discharge-side surface 13 thereof. In response to a temperature rise of flowing air, the bimetal 15 deforms to increase the amount of camber C of the blade 12, so that the flow rate of the flowing air increases in a high-temperature state. On the other hand, in a low-temperature state, the amount of camber C decreases, so that the flow rate of the flowing air decreases; as a result, the noise of and drive power for the fan decrease.

In the foregoing conventional blade, however, the deformation of the blade 12 following the torsional deformation of the bimetal 15 caused by a temperature rise of the flowing air leads mainly to a variation in the amount of camber C as shown in FIG. 7, not causing a variation in the angle of incidence $\alpha$ effectively; accordingly, an increase only in the amount of camber C results in no appreciable variation in the flow rate, thus, a desired effect cannot be attained. Therefore, a fan clutch of the temperature-sensitive type must be used inevitably, this complicating a control mechanism, enlarging the whole size of the blower, and increasing the weight thereof.

SUMMARY OF THE INVENTION

In view of the foregoing drawbacks in the prior art, it is an object of the present invention to provide a blower fan blade which needs no use of a temperature-sensitive type fan clutch, is capable of providing a maximum flow rate in a high-temperature state and decreasing the flow rate of flowing air with reduced noise in a low-temperature state, and thus can vary the angle of incidence effectively with no appreciable variation in the amount of camber.

To achieve the foregoing object, the present invention provides a blade of a blower fan having a plurality of blades projecting radially outward from the outer periphery of an attaching member with an attaching wall, which is characterized in that a parallel wire group, such as a metallic thin wire group or a fibrous member, whose thermal expansion coefficient is smaller than that of the blade is provided substantially over the whole area of a suction-side surface and of a discharge-side surface of the blade such that the two paralle wire groups extend from the front edge of the suction-side surface and from the rear edge of the discharge-side surface outward obliquely to the radial direction of the blade to cross each other on the face and back sides so as to result in the shape of an "X". The arrangement angle of the wire group is from 10° to 70° with respect to the radial center line of the blade on either side thereof.

According to the present invention in which the two parallel metallic thin wire groups or fibrous members are provided obliquely over the whole areas of both sides with an arrangement angle of 10° to 70° to cross each other on the face and back sides so as to result in the shape of an "X", due to a difference of thermal expansion coefficient, camber appears on the blade in oblique directions in response to a temperature rise of flowing air, and the front edge and the rear edge camber in opposite directions; thus, the blade as a whole undergoes torsional deformation to largely vary the angle of incidence. In this regard, since the force of camber acts only in the oblique direction of the metallic thin wire group or fibrous member on each side and over the whole area of each side, the whole blade can be subjected to smooth and large torsional deformation.

DETAILED DESCRIPTION OF THE PREFERRED EMBODIMENTS

Figure 1:
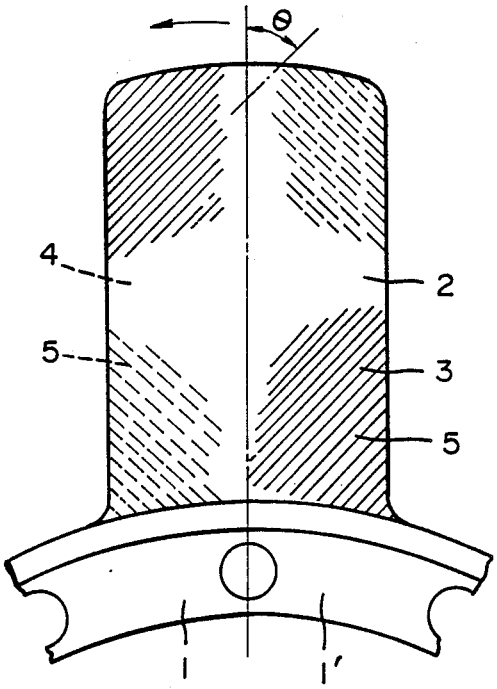
FIG. 1 is a fragmentary front view of a blower fan with blades according to an embodiment of the present invention.

In FIGS. 1 through 4, 1 designates an annular boss with an attaching wall 1' to be attached via a pulley or the like to a mating rotary body (not shown) such as an impeller shaft of a water pump, which serves as an attaching member. This annular boss has a plurality of fan blades 2 projecting radially outward from the outer periphery thereof. Each blade 2 is made of synthetic resin, such as nylon-66 or polypropylene. Provided substantially over the whole area of a suction-side surface 4 and of a discharge-side surface 3 of the blade is a parallel wire group 5, such as a metallic thin wire group or a fibrous member, whose thermal expansion coefficient is smaller than that of the blade. Specifically, one parallel wire group extends from the front edge of the suction-side surface 4 outward obliquely to the radial direction of the blade 2, whereas the other parallel wire group extends from the rear edge of the discharge-side surface 3 outward obliquely to the radial direction of the blade 2, such that these parallel wire groups cross each other on the face and back sides to result in the shape of an "X".

The arrangement angle $\theta$ of the metallic thin wire group or fibrous member 5 must be from 10° to 70° on both, face and back sides with respect to the center line of the blade 2. If this angle falls outside the foregoing range of angles, the blade undergoes no torsional deformation; thus, a desired amount of deformation per temperature cannot be obtained in relation to the angle of incidence $\alpha$. On the other hand, when the angle $\theta$ is within the range of 20° to 45°, the amount of deformation becomes large satisfactorily. In this case, the angle $\theta$ for the discharge-side surface may be made different from that for the suction-side surface, or, if the angle $\theta$ for the discharge-side surface is made larger, a corresponding camber results.

Figure 4:
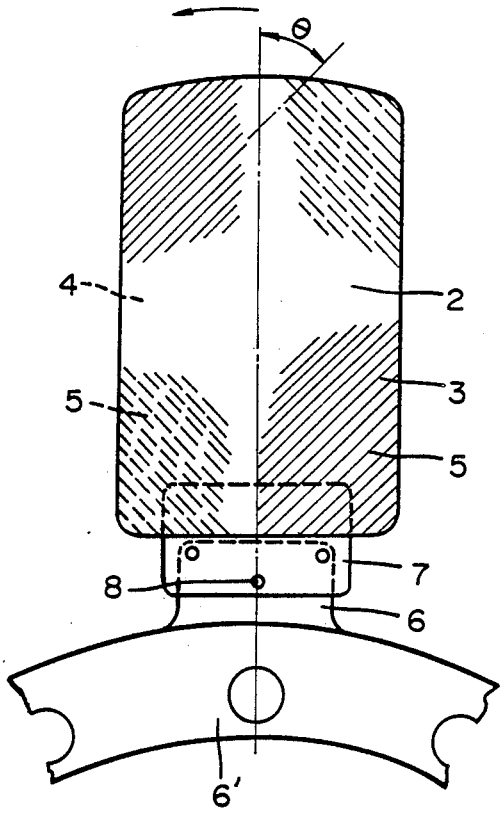
FIG. 4 is a fragmentary front view showing another embodiment of the present invention.
Figure 5:
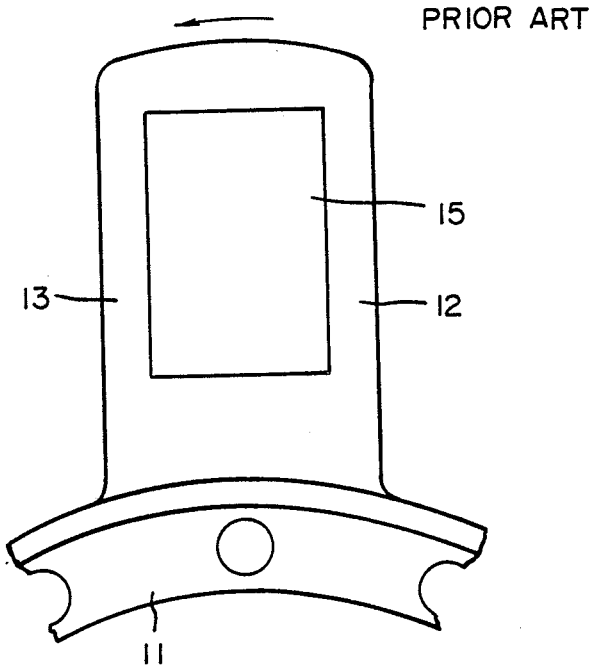
FIGS. 5 through 7 are views showing a conventional blower fan and blade, corresponding to FIGS. 1 through 3.
Figure 6:
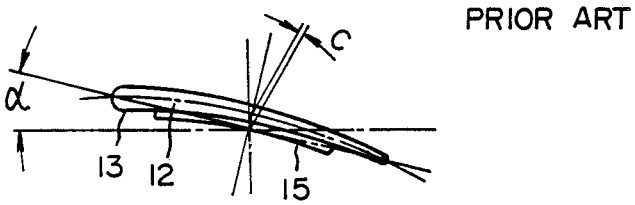
Figure 7:
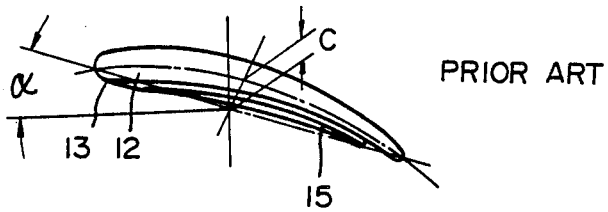

In place of the annular boss, as shown in FIG. 4, the attaching member may be made of a spider 6 with an attaching wall 6'; in this case, an insert 7 fixed to the blade 2 may be secured to the spider 6 by the use of a rivet 8.

The metallic thin wire means piano wire, stainless steel wire, phosphor bronze wire, etc., and the fibrous member may be made of glass fiber, carbon fiber, aramide fiber, etc. The metallic thin wire group is bonded to the surface of the blade 2 using epoxy resin, whereas the fibrous member is formed, after integrally molding the blade 2 together with the insert 7, by impregnating mutually-confronting glass fibers with the same substance as that of the blade 2 and applying a sheet prepreg thus molded to the blade.

To examine a variation in the angle of incidence $\alpha$, the following two samples were prepared:

(a) a piano wire group of 0.1 m/m wire diameter was tightly bonded, using epoxy resin, to each, face/back side of a blade molded with nylon-66 as shown in FIG. 1, and (b) mutually-contronting glass fibers were impregnated with polypropylene, and a sheet prepreg thus molded was applied to a blade molded integrally together with an insert using polypropylene as shown in FIG. 4.

When the flowing air temperature increased by 50°, the angle of incidence $\alpha$ of the blade 2 increased by about 20° in the case of (a) sample and by about 22° in the case of (b) sample.

Figure 2:
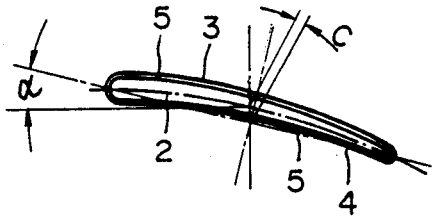
FIG. 2 is a top view of the blade in a low-temperature state.
Figure 3:
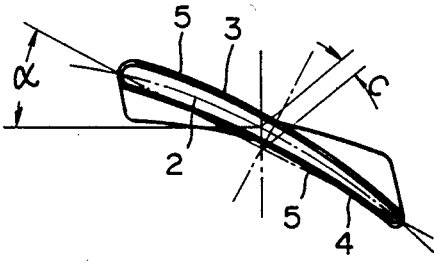
FIG. 3 is a top view of the blade in a high-temperature state.

Reference symbol C in FIGS. 2 and 3 designates the amount of camber in a low-temperature state and in a high-temperature state, respectively, and the solid-line arrow in FIG. 1 designates the direction of rotation of the blower fan.

As described above, in the blower fan blade according to the present invention, the metallic thin wire group or fibrous member 5 is provided substantially over the whole area of each of the suction-side surface 4 and the discharge-side surface 3, and the individual parallel wires or fibers extend obliquely such that they cross each other on the face and back sides to result in the shape of an "X". In operation, because of a difference of thermal expansion coefficient, the whole fan blade 2 undergoes torsional deformation as the ambient temperature increases due to the flowing air; as a result, the angle of incidence $\alpha$ varies smoothly and largely. Accordingly, a maximum flow rate can be obtained effectively in a high-temperature state without the use of a costly and weighty fan clutch of the temperature-sensitive type, thus, there can be provided the blower fan with very effective blades.

What is claimed is:

1. A blade of a blower fan having a plurality of blades projecting radially outward from the outer periphery of an attaching member with an attaching wall, characterized in that a parallel wire group whose thermal expansion coefficient is smaller than that of the blade is provided substantially over the whole area of a suction-side surface and of a discharge-side surface of the blade such that the two parallel wire groups extend from the front edge of the suction-side surface and from the rear edge of the discharge-side surface outward obliquely to the radial direction of the blade to cross each other on the face and back sides so as to result in the shape of an "X".

2. A blower fan blade according to claim 1, wherein the arrangement angle of the wire group is from 10° to 70° with respect to the radial center line of the blade on either side thereof.

3. A blower fan blade according to claim 2, wherein the arrangement angle is from 20° to 45°.

4. A blower fan blade according to claim 1, wherein the parallel wire group is made of a metallic thin wire group or a fibrous member.

5. A blower fan blade according to claim 4, wherein the metallic thin wire group is made of piano wire, stainless steel wire, or phosphor bronze wire.

6. A blower fan blade according to claim 4, wherein the fibrous member is made of glass fiber, carbon fiber, or aramide fiber.

7. A blower fan blade according to claim 5, wherein the metallic thin wire group is bonded to the surface of the blade.

8. A blower fan blade according to claim 6, wherein the fibrous member is formed by applying, to the surface of the blade, a sheet prepreg molded by impregnating mutually-confronting fibers.

9. A blower fan blade according to claim 1, wherein the blade is made of nylon-66 or polypropylene.

10. A blower fan blade according to claim 1, wherein the attaching member is an annular boss.

11. A blower fan blade according to claim 1, wherein the attaching member is a spider with an attaching wall.

* * * * *